US005695085A

United States Patent [19]

Hadener

[11] Patent Number: 5,695,085

[45] Date of Patent: Dec. 9, 1997

[54] BEVERAGE CAN WITH AN OPENER

[76] Inventor: Albert K. Hadener, 20340 Hacienda Ct., Boca Raton, Fla. 33498

[21] Appl. No.: 728,968

[22] Filed: Oct. 11, 1996

[51] Int. Cl.[6] ..... B65D 17/34

[52] U.S. Cl. ..... 220/269; 220/271; 220/906

[58] Field of Search ..... 220/269, 271, 220/906

[56] References Cited

U.S. PATENT DOCUMENTS

| | | | |
|---|---|---|---|
| 4,213,538 | 7/1980 | Boardman | 220/268 |
| 5,011,037 | 4/1991 | Moen et al. | 220/271 |
| 5,285,919 | 2/1994 | Recchia | 220/271 |
| 5,397,014 | 3/1995 | Aydt | 220/269 |
| 5,494,184 | 2/1996 | Noguchi et al. | 220/269 |

*Primary Examiner*—Stephen Cronin

[57] ABSTRACT

A beverage can with an opener is disclosed. The beverage can has a closed bottom end and an open top end and a side wall therebetween. A circular top is positioned over the top end and sealingly secured thereto. A first pouring opening in the top is located adjacent to the periphery thereof. A second vent opening in the top is located adjacent to the periphery thereof. A cylindrical fulcrum is secured to the top in the center thereof. A tab is received at its center on the intermediate central support of the fulcrum. The tab has a lower surface spaced above the top thereby forming a space therebetween. Pivoting one end of the tab will contact the enlarged pouring opening to open it and pivoting the other end of the tab will contact the small vent opening to open it.

1 Claim, 2 Drawing Sheets

BEVERAGE CAN WITH AN OPENER

BACKGROUND OF THE INVENTION

1. Field of the Invention

The present invention relates to a new and improved beverage can with an opener and, more particularly, pertains to forming an enlarged pouring opening and a small vent opening in a beverage can prior to use.

2. Description of the Prior Art

The use of cans and/or openers of various designs and configurations is known in the prior art. More specifically, cans and/or openers of various designs and configurations heretofore devised and utilized for the purpose of forming an opening in the top of a container by various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for forming an enlarged pouring opening and a small vent opening in a beverage can prior to use. By way of example, U.S. Pat. No. 4,998,641 to Willoughby discloses a top for beverage can which includes a scored portion which can be displaced to provide an access opening.

U.S. Pat. No. 5,065,882 to Sugiyama discloses a beverage can top with a ring serving as a jig.

U.S. Pat. No. 5,129,541 to Voight et al. discloses an easy open ecology end for cans.

U.S. Pat. No. 5,224,618 to Garbiso discloses an easy opening tab for containers.

Lastly, U.S. Pat. No. 5,335,808 to Lee discloses an easy opening pop top can lid.

In this respect, the beverage can with an opener according to the present invention substantially departs from the conventional concepts and designs of the prior art, and in doing so provides an apparatus primarily developed for the purpose of forming an enlarged pouring opening and a small vent opening in a beverage can prior to use.

Therefore, it can be appreciated that there exists a continuing need for a new and improved beverage can with an opener which can be used for forming an enlarged pouring opening and a small vent opening in a beverage can prior to use. In this regard, the present invention substantially fulfills this need.

SUMMARY OF THE INVENTION

In view of the foregoing disadvantages inherent in the known types of cans and/or openers of various designs and configurations now present in the prior art, the present invention provides an improved beverage can with an opener. As such, the general purpose of the present invention, which will be described subsequently in greater detail, is to provide a new and improved beverage can with an opener and methods which have all the advantages of the prior art and none of the disadvantages.

To attain this, the present invention essentially comprises a new and improved beverage can with an opener comprising, in combination, an aluminum beverage can having a closed bottom end and an open top end and an essentially cylindrical side wall therebetween; a circular top positioned over the top end and sealingly secured thereto around the adjacent peripheries; a first enlarged pouring opening in the top adjacent to the periphery thereof; a second small vent opening in the top adjacent to the periphery thereof at a location diametrically opposed from the enlarged pouring opening; a cylindrical fulcrum having a lower end secured to the top in the center thereof with an intermediate central support and an enlarged support at the upper end; and a generally oval tab received at its center on the intermediate central support of the fulcrum and held in place by the upper enlarged support, the tab having a lower surface spaced above the top thereby forming a space therebetween of between about one and three times the thickness of the tab whereby pivoting one end of the tab will contact the enlarged pouring opening to open it and pivoting the other end of the tab will contact the small vent opening to open it.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beverage can with an opener which has all the advantages of the prior art cans and/or openers of various designs and configurations and none of the disadvantages.

It is another object of the present invention to provide a new and improved beverage can with an opener which may be easily and efficiently manufactured and marketed.

It is a further object of the present invention to provide a new and improved beverage can with an opener which is of a durable and reliable construction.

An even further object of the present invention is to provide a new and improved beverage can with an opener which is susceptible of a low cost of manufacture with regard to both materials and labor, and which accordingly is then susceptible of low prices of sale to the consuming public, thereby making such cans and/or openers of various designs and configurations economically available to the buying public.

Still yet another object of the present invention is to provide a new and improved beverage can with an opener which provides in the apparatuses and methods of the prior art some of the advantages thereof, while simultaneously overcoming some of the disadvantages normally associated therewith.

Even still another object of the present invention is to form an enlarged pouring opening and a small vent opening in a beverage can prior to use.

Lastly, it is an object of the present invention to provide a beverage can with an opener. The beverage can has a closed bottom end and an open top end and a side wall therebetween. A circular top is positioned over the top end and sealingly secured thereto. A first pouring opening in the top is located adjacent to the periphery thereof. A second vent opening in the top is located adjacent to the periphery thereof. A cylindrical fulcrum is secured to the top in the center thereof. A tab is received at its center on the intermediate central support of the fulcrum. The tab has a lower surface spaced above the top thereby forming a space therebetween. Pivoting one end of the tab will contact the enlarged pouring opening to open it and pivoting the other end of the tab will contact the small vent opening to open it.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
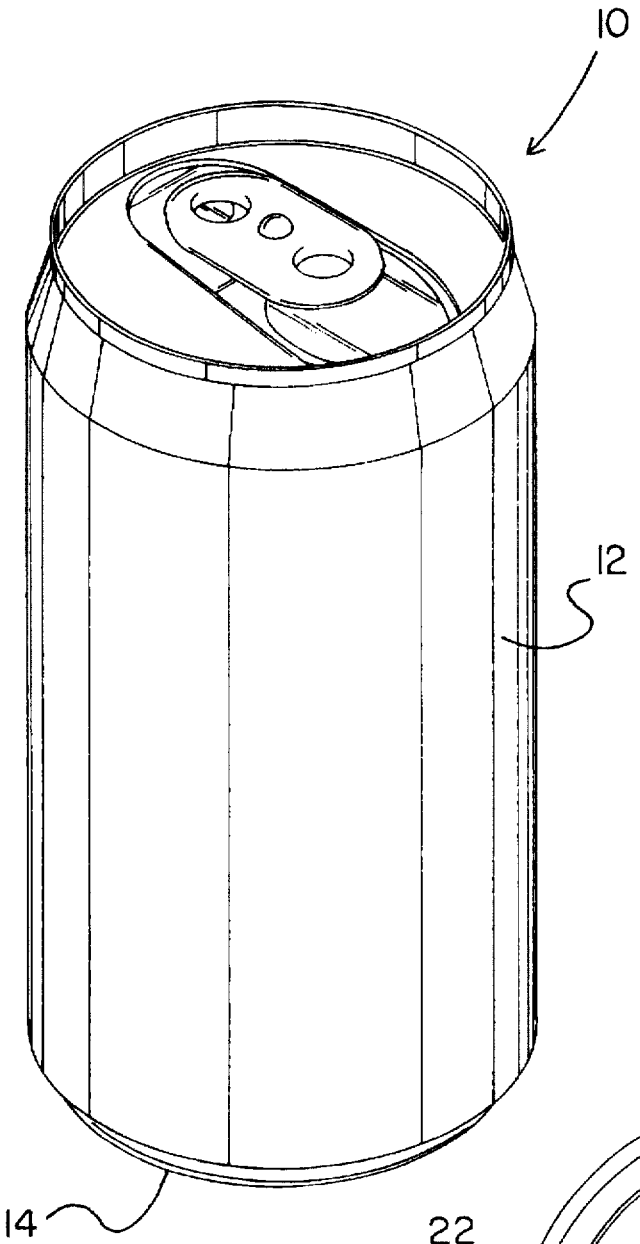
FIG. 1 is a perspective illustration of the preferred embodiment of the new and improved beverage can with an opener constructed in accordance with the principles of the present invention.
Figure 2:
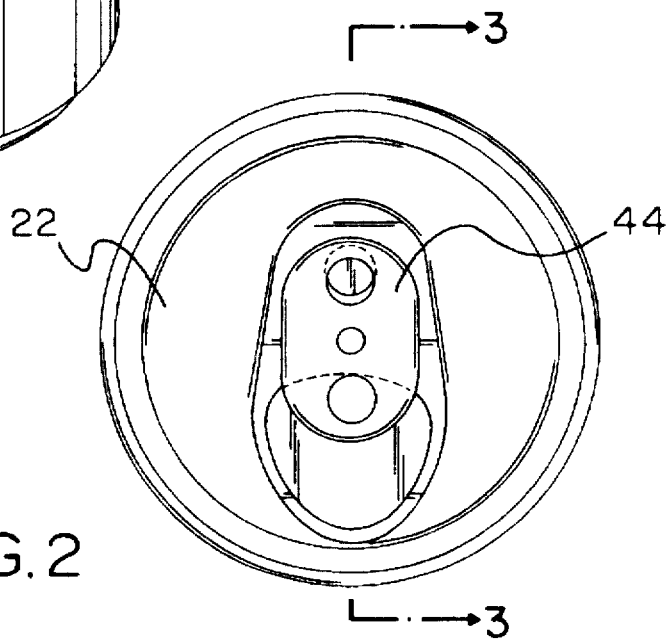
FIG. 2 is a top elevational view of the can shown in FIG. 1.
Figure 4:
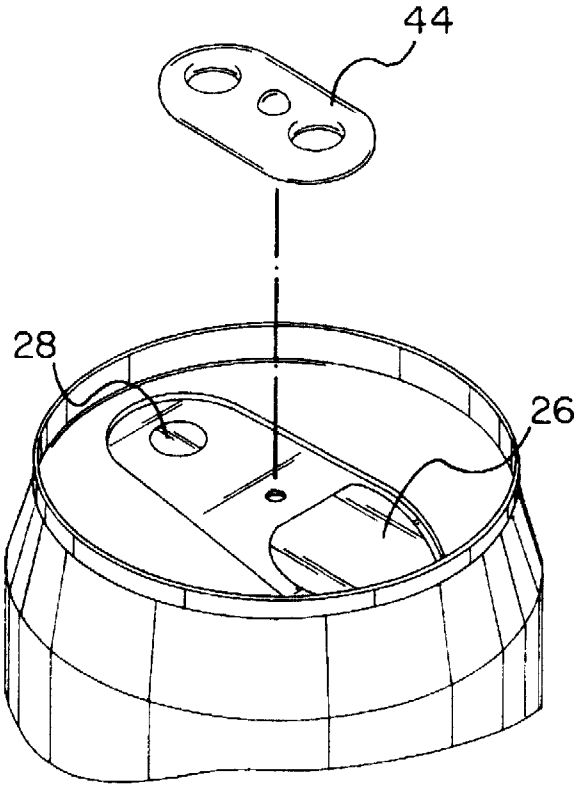
FIG. 4 is an enlarged perspective exploded view of the can shown in the prior Figures.
Figure 3:
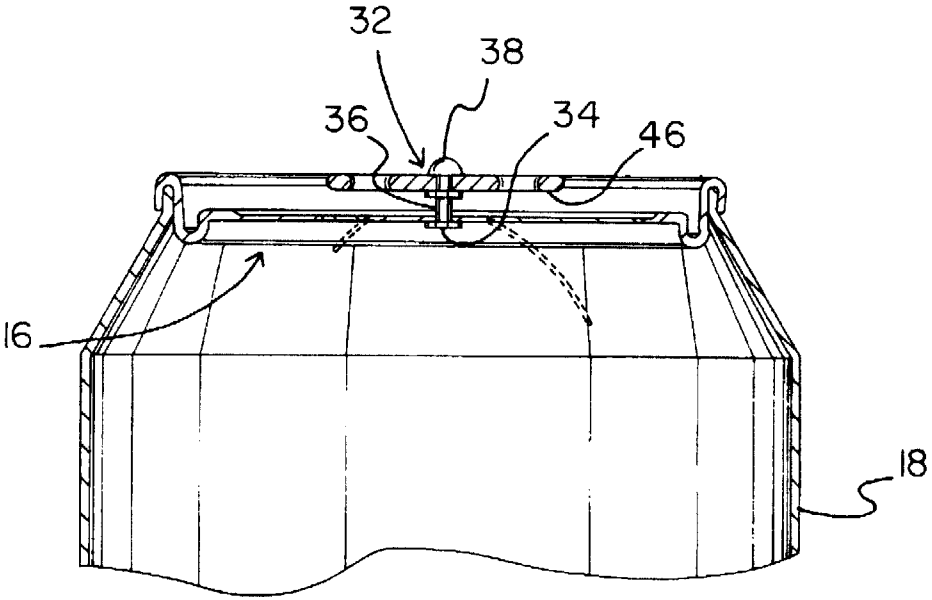
FIG. 3 is a cross-sectional view taken along line 3—3 of FIG. 2.

With reference now to the drawings, and in particular to FIG. 1 thereof, the preferred embodiment of the new and improved beverage can with an opener embodying the principles and concepts of the present invention and generally designated by the reference numeral 10 will be described.

The present invention, the new and improved beverage can with an opener is a system 10 comprised of a plurality of components. In their broadest context, the components include a can, a top, a first pouring opening, a second vent opening, a fulcrum and a tab. Each of the individual components is specifically configured and correlated one with respect to the other so as to attain the desired objectives.

The central component of the system 10 of the present invention is an aluminum beverage can 12. The can is formed to have a closed bottom end 14 and an open top end 16. Such ends are in parallel relationship one above the other. In addition, an essentially cylindrical side wall 18 is formed in the can between the top and bottom ends.

The next component of the system 10 is a circular top 22. Such top is positioned over the top end of the can and forms an integral part thereof. It is sealingly secured around the top end at its periphery to the periphery of the can. The adjacent peripheries of the top and can are thus sealed to totally seal the contents of the container.

Formed in the top are two openings. The first opening is an enlarged pouring opening 26. Such first opening is formed in the top adjacent to the periphery thereof. The opening takes a form resembling a triangular with three sides but the sides are curved. The periphery of such opening is metal such as aluminum, the material of the can and top, but with a periphery fabricated to allow separation of the area within the markings prior to use. The second small vent opening 28 is also formed in the top of the can. It is circular in shape and is adapted to define an area to be opened upon the application of pressure.

In order to open the can at the areas defined by the pouring opening and the vent opening, there is provided a cylindrical fulcrum 32. The fulcrum has a lower end 34 secured to the top in the center thereof. It has an intermediate central support 36. It also has an enlarged support 38 at its upper end 40.

Lastly provided is a generally oval tab 44. The tab is received at its center on the intermediate central support of the fulcrum. It is held in place by the upper enlarged support therebeneath. The tab has a lower surface 46 spaced from the top. In this manner, a space is formed between the tab and the top. Such space is between about one and three times the thickness of the tab.

In operation and use, the tab is formed with one end over the enlarged pouring opening and the other end over the small vent opening. In this manner, pivoting one end of the tab will contact the enlarged pouring opening to open it. Pivoting the other end of the tab will contact the small vent opening to open it. The can is now prepared for a user to drink the contents thereof.

The present invention is a specially designed beverage can that enables pouring beverages from a can so equipped with a smoother and faster flow. It is made of aluminum and consists of a pull tab, a center fulcrum, a slight depression for the can opening, and a smaller vent depression. The pull tab resembles a typical oval-shaped tab except that it is slightly elevated above the can's top surface. A small cylindrical fulcrum fastened perpendicularly to the can's top is positioned under the tab in its center. The pull tab's front end is positioned over the rear of the main opening, while its other end is over the circular vent. All of the surfaces are smooth and all edges are rounded.

In use, grasp the pull tab's rear end and lift it, causing the front of the tab to push down on the opening. The conventional hole is thereby opened, allowing liquid to flow out. By lifting the front end of the tab, the vent in the back pushes down and opens up. Lift the can, tilt it, and pour its contents into a glass, or drink directly from the can if desired.

This novel can enables smoother pouring so that no mess is made. The can may be emptied quicker and more easily than a conventional can. Also, the tab's slightly elevated position eliminates the problems that sometimes occur when attempting to open a conventional beverage can.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved beverage can with an opener comprising, in combination:

an aluminum beverage can having a closed bottom end and an open top end and an essentially cylindrical side wall therebetween;

a circular top positioned over the top end of and sealingly secured thereto around the adjacent peripheries;

a first enlarged pouring opening in the top adjacent to the periphery thereof;

a second small vent opening in the top adjacent to the periphery thereof at a location diametrically opposed from the enlarged pouring opening;

a cylindrical fulcrum having a lower end secured to the top in the center thereof with an intermediate central support and an enlarged support at the upper end; and a generally oval tab received at its center on the intermediate central support of the fulcrum and held in place by the enlarged upper support, the tab having a lower surface spaced above the top thereby forming a space therebetween of between about one and three times the thickness of the tab whereby opposing ends of the tab are elevated above the circular top and pivoting one end of the tab will contact the enlarged pouring opening to open it and pivoting the other end of the tab will contact the small vent opening to open it.

* * * * *